US008086134B2

(12) United States Patent
Xu et al.

(10) Patent No.: US 8,086,134 B2
(45) Date of Patent: Dec. 27, 2011

(54) DEVELOPING UNIT INCLUDING SIDE SEAL MEMBER BETWEEN END OF DEVELOPER CARRIER AND HOUSING

(75) Inventors: Fan Xu, Nagoya (JP); Mitsuru Horinoe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 315 days.

(21) Appl. No.: 12/412,949

(22) Filed: Mar. 27, 2009

(65) Prior Publication Data

US 2009/0274481 A1 Nov. 5, 2009

(30) Foreign Application Priority Data

Apr. 30, 2008 (JP) ..... 2008-118386

(51) Int. Cl.
*G03G 15/08* (2006.01)

(52) U.S. Cl. ..... 399/103

(58) Field of Classification Search ..... 399/103, 399/105, 106, 102
See application file for complete search history.

(56) References Cited

U.S. PATENT DOCUMENTS

| | | | | |
|---|---|---|---|---|
| 6,336,014 | B1 | 1/2002 | Sato et al. | |
| 6,901,228 | B2 | 5/2005 | Kamimura et al. | |
| 2006/0245783 | A1 * | 11/2006 | Kamimura et al. | 399/103 |
| 2007/0071489 | A1 | 3/2007 | Nakaya et al. | |
| 2007/0140729 | A1 * | 6/2007 | Carter et al. | 399/103 |
| 2009/0274482 | A1 * | 11/2009 | Xu et al. | 399/105 |

FOREIGN PATENT DOCUMENTS

| | | | |
|---|---|---|---|
| EP | 1347346 | A2 | 9/2003 |
| JP | 2001-022179 | | 1/2001 |
| JP | 2003-107902 | | 4/2003 |
| JP | 2006-249383 | A | 9/2006 |
| JP | 2007-093951 | | 4/2007 |
| JP | 2007-179080 | | 7/2007 |

OTHER PUBLICATIONS

Extended EP Search Report dtd Oct. 7, 2011, EP Appln. 09004497.5.

* cited by examiner

*Primary Examiner* — Sophia S Chen
(74) *Attorney, Agent, or Firm* — Banner & Witcoff, Ltd

(57) ABSTRACT

A developing unit is provided that includes a developer carrier; a housing; and a side sealing member disposed between an end part of the developer carrier and a portion of the housing adjacent to a supply port. The side sealing member includes an upstream side seal and a downstream side seal. The upstream side seal is configured to convey a developer on the upstream side seal in an oblique direction toward the supply port and the downstream side. The downstream side seal is configured to convey a developer on the downstream side seal in a direction toward the downstream side.

6 Claims, 4 Drawing Sheets

DEVELOPING UNIT INCLUDING SIDE SEAL MEMBER BETWEEN END OF DEVELOPER CARRIER AND HOUSING

CROSS REFERENCE TO RELATED APPLICATION

The present disclosure relates to the subject matter contained in Japanese patent application No. 2008-118386 filed on Apr. 30, 2008, which is expressly incorporated herein by reference in its entirety.

TECHNICAL FIELD

The present invention relates to a developing unit provided with a side seal member that seals between an end part of a developing roller and a developing unit housing.

BACKGROUND ART

Japanese patent publication 2001-22179A (U.S. Pat. No. 6,336,014) discloses a side seal member that is provided between an end part of a rotatable developing roller and a developing unit housing and that is located adjacent to a developer supply port of the developing unit housing. The side sealing member includes an upstream side base, a downstream side base and a felt member adhered to the upper surfaces of the upstream and downstream bases.

Because fibers of the felt member are not unidirectional, developer entering the felt member may be moved in a direction away from the supply port by sliding contact between the felt member and the developing roller to cause toner leakage.

SUMMARY

The present invention was made in view of the above-noted and/or other circumstances.

As one of illustrative, non-limiting embodiments, the present invention can provide a developing unit including a developer carrier; a housing; and a side sealing member disposed between an end part of the developer carrier and a portion of the housing adjacent to a supply port. The side sealing member includes an upstream side seal and a downstream side seal. The upstream side seal is configured to convey a developer on the upstream side seal in an oblique direction toward the supply port and the downstream side. The downstream side seal is configured to convey a developer on the downstream side seal in a direction toward the downstream side.

Accordingly, as one of advantages, the present invention can provide a developing unit capable of preventing developer from leaking. The above-noted advantage and other advantages of the present invention will be described in detail with reference to the accompanying drawings.

DESCRIPTION OF THE PREFERRED EMBODIMENT

Figure 1:
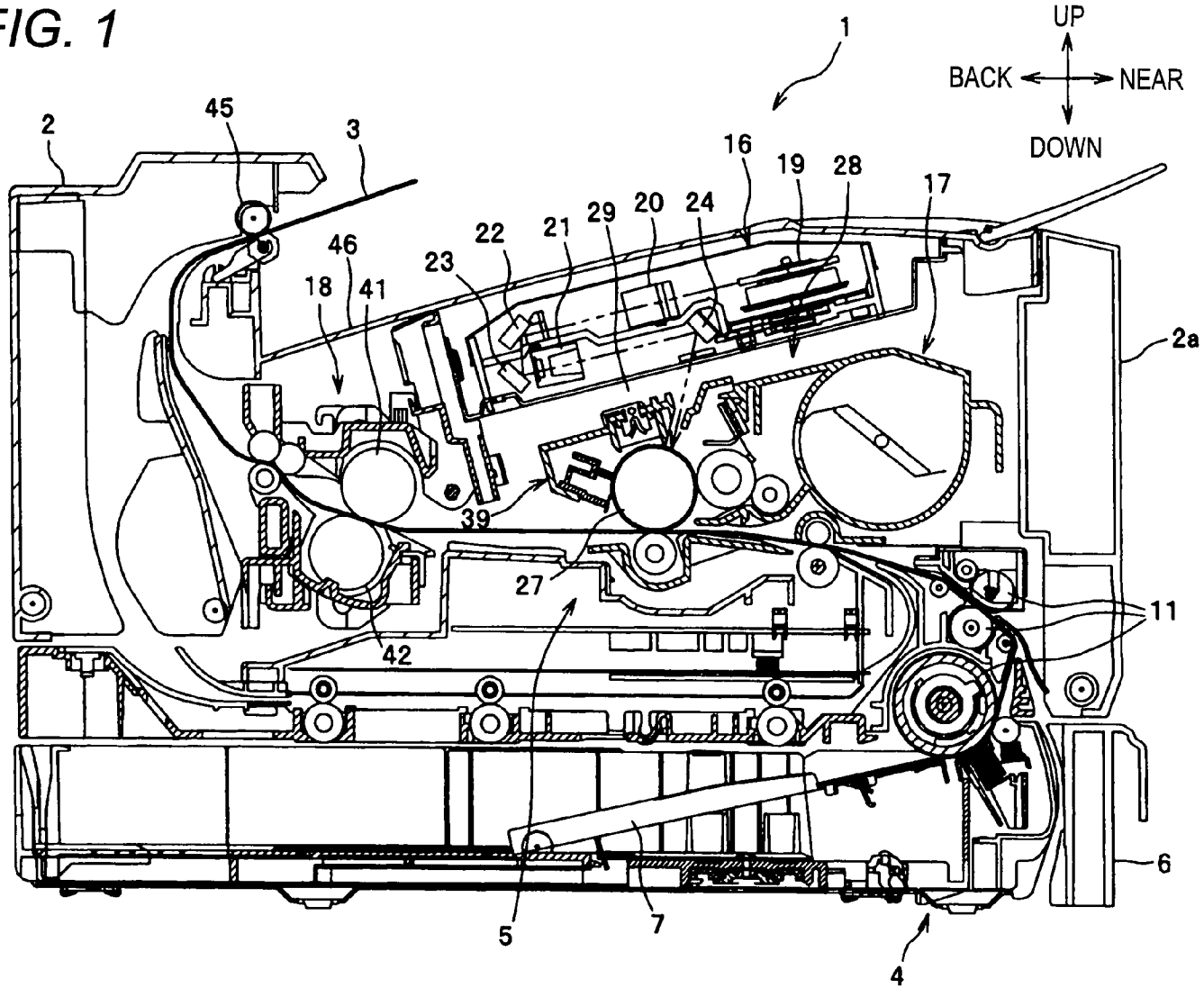
FIG. 1 is a side sectional view showing a laser printer having a development cartridge.
Figure 2:
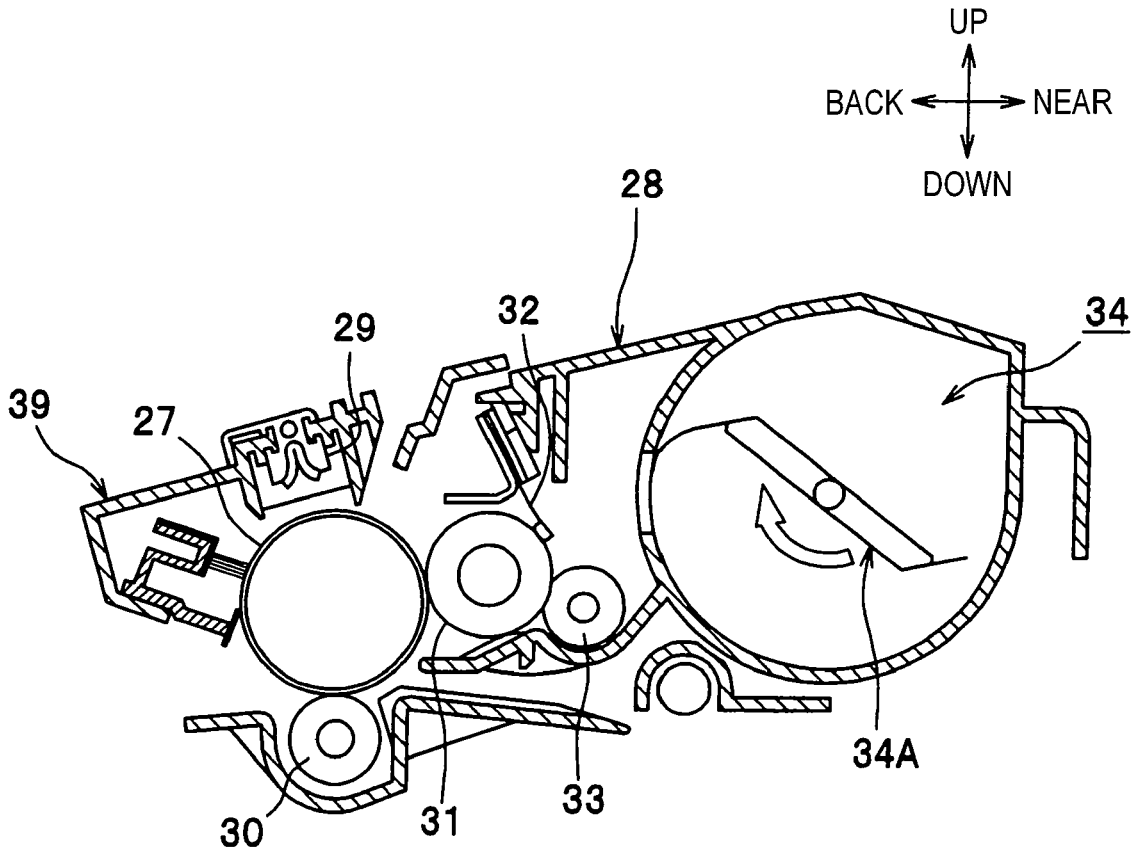
FIG. 2 is a side sectional view showing the development cartridge.
Figure 3A:
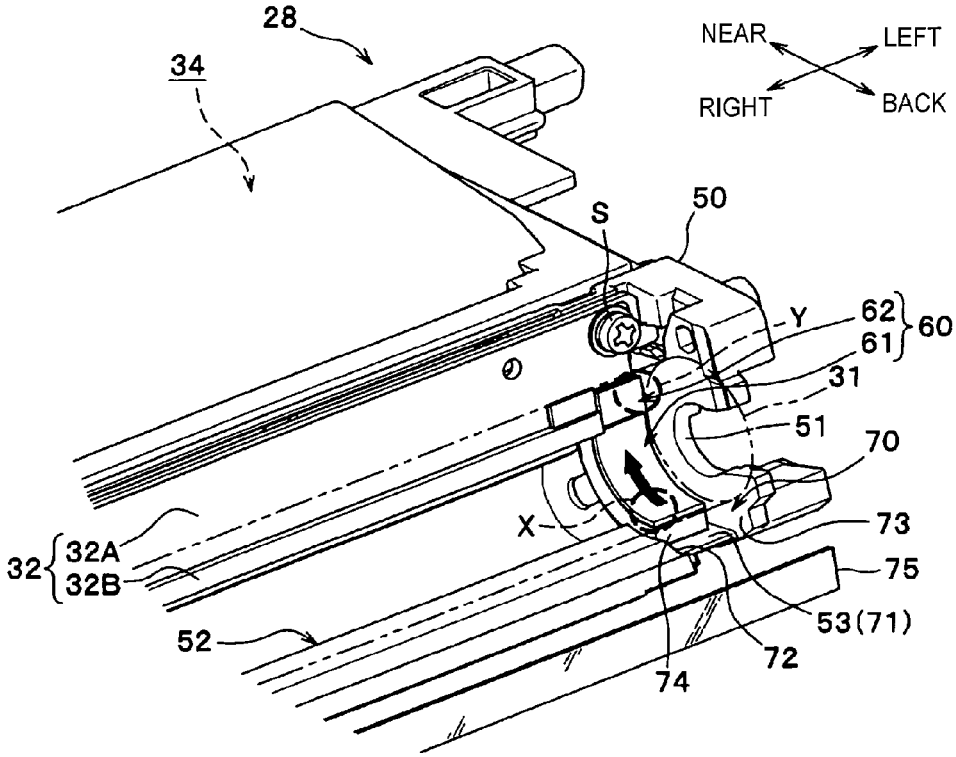
FIG. 3(*a*) is an enlarged perspective view showing a structure of a side sealing member, FIG. 3(*b*) is a sectional view showing details of the side sealing member, FIG. 3(*c*) is an enlarged perspective view of a portion X of FIG. 3(*a*), and FIG. 3(*d*) is an enlarged perspective view of a portion Y of FIG. 3(*a*).
Figure 3B:
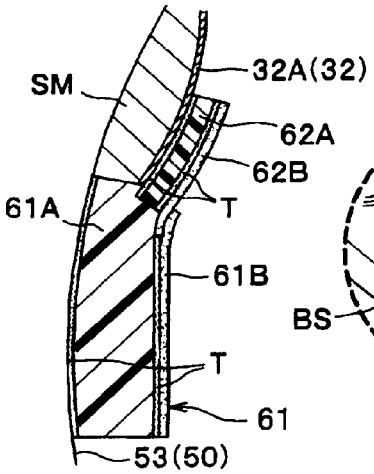
Figure 3C:
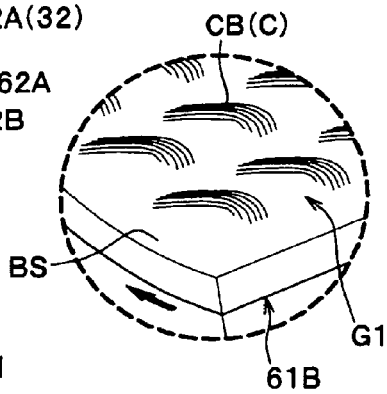
Figure 3D:
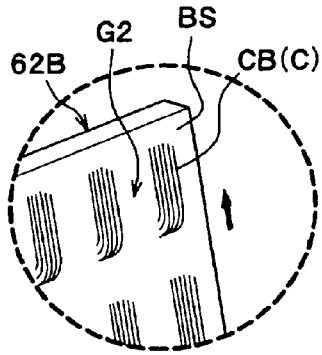

A detailed description is given of an exemplary embodiment with reference to the drawings. FIG. 1 is a side sectional view showing a laser printer provided with a development cartridge, and FIG. 2 is a side sectional view showing the development cartridge. In the following description, the directions are specified based on a user who uses the laser printer 1. That is, in FIG. 1, the right side is called the "near side", the left aide is called the "back side", the back side in the perpendicular direction of the paper is called the "right side", and the near side in the perpendicular direction of the paper is called the "left side". In addition, since the up-down direction in the drawings is coincident with the up-down direction specified based on a user who uses the printer, the "up-down" direction is simply used. These directions are intended to facilitate understanding of the structure of the printer 1 and should not be interpreted in a restrictive sense.

(Entire Configuration of Laser Printer)

As shown in FIG. 1, the laser printer 1 includes a main casing 2, and a feeder portion 4 for feeding sheets 3 and an image forming portion 5 for forming images on a sheet 3, which are located inside the main casing 2.

(Configuration of Feeder Portion)

The feeder portion 4 includes a sheet feeding tray 6 removably mounted to the inner bottom of the main casing 2 and a sheet pressing plate 7 disposed inside the sheet feeding tray 6. The feeder portion 4 has various rollers 11 for conveying sheets 3 and removing paper dust. The feeder portion 4 functions so that sheets 3 in the sheet feeding tray 6 are biased upward by the sheet pressing plate 7 and are conveyed to the image forming portion 5 by the rollers 11.

(Configuration of Image Forming Portion)

The image forming portion 5 includes a scanner unit 16, a process cartridge 17 and a fixing unit 18.

(Configuration of Scanner Unit)

The scanner unit 16 is disposed in the inner upper part of the main casing 2 and includes a laser beam emitting portion (not illustrated), a polygon mirror 19 driven to turn, lenses 20, 21, and reflection mirrors 22, 23 and 24. A laser beam passes thought the scanner unit 16 along a path shown by a chain line in FIG. 1 to be irradiated on the surface of a photosensitive drum 27 for scanning at high speed.

(Configuration of Process Cartridge)

The process cartridge 17 is removable from and mountable to the main casing 2 when a front cover 2*a* at the near side of the main casing 2 is open. The process cartridge 17 includes a development cartridge 28 as an example of a developing unit and a drum unit 39.

The development cartridge 28 is removable from and mountable to the main casing 2 in a state where the development cartridge 28 is mounted to the drum unit 39. Alternatively, the drum unit 39 may be fixed to the main casing 2, and the development cartridge 28 per se may be removably mountable to the drum unit 39 fixed to the main casing 2. As shown in FIG. 2, the development cartridge 28 includes a developing roller 31 as an example of a developer carrier, a layer thickness regulating blade 32 as an example of a layer thickness regulating member, a supply roller 33 and a developer accommodating chamber 34.

In the development cartridge 28, toner as an example of a developer in the developer accommodating chamber 34 is agitated by an agitator 34A and thereafter supplied to the developing roller 31 by the supply roller 83. When the toner is supplied to the developing roller 31 by the supply roller 33, the toner is positively friction-charged between the supply roller 33 and the developing roller 31. As the developing roller 31 rotates, the toner supplied onto the developing roller 31 enters between the layer thickness regulating blade 32 and the developing roller 31 so that the toner is further friction-charged while the toner on the developing roller 31 is regulated to a constant thickness. This way, a thin layer of the toner is carried on the developing roller 31. A detailed description will be given later of the development cartridge 28.

The drum unit 39 includes a photosensitive drum 27, a Scorotron type charger 29 and a transfer roller 30. The surface of the photosensitive drum 27 in this drum unit 39 is positively charged uniformly by the Scorotron type charger 29 and thereafter exposed by a high-speed scanning of the laser beam emitted from the scanner unit 16. Consequently, the potential at the exposed portion is lowered to form an electrostatic latent image based on image data.

As the developing roller 31 rotates, the toner carried on the developing roller 31 is supplied to the electrostatic latent image formed on the surface of the photosensitive drum 27 to form a toner image on the surface of the photosensitive drum 27. Thereafter, a sheet 3 is conveyed between the photosensitive drum 27 and the transfer roller 30 so that the toner image carried on the surface of the photosensitive drum 27 is transferred onto the sheet 3.

(Configuration of Fixing Part)

As shown in FIG. 1, the fixing unit 18 includes a heating roller 41 and a pressing roller 42 disposed opposite the heating roller 41 to press the heating roller 41. When the sheet 3 passes between the heating roller 41 and the pressing roller 42, toner transferred on the sheet 3 is thermally fixed to the sheet 3. The sheet 3 having the toner image thermally fixed by the fixing unit 18 is conveyed to a discharge roller 45 disposed at the downstream side of the fixing unit 18 to be fed out from the discharge roller 45 onto a discharge tray 46.

(Detailed Structure of Development Cartridge)

Figure 4:
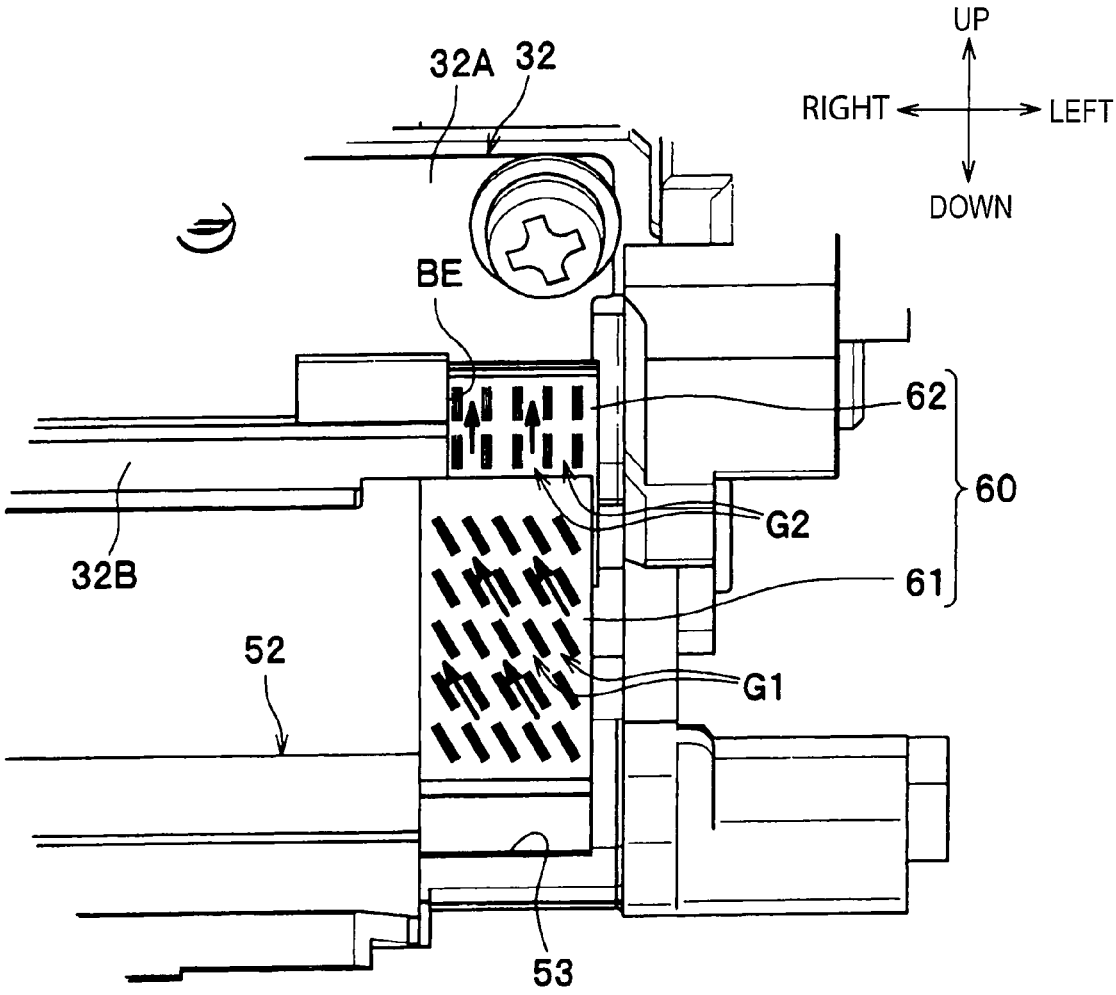
FIG. 4 is a front elevational view showing directions in which toner is conveyed by an upstream side seal and a downstream side seal.

Next, a detailed description is given of the structure of the development cartridge 28. FIG. 3(*a*) is an enlarged perspective view showing the structure around a side sealing member, FIG. 3(*b*) is a sectional view showing the details of the side sealing member, FIG. 3(*c*) is an enlarged perspective view of X portion in FIG. 3(*a*) and FIG. 3(*d*) is an enlarged perspective view of Y portion in FIG. 3(*a*). FIG. 4 is a front elevational view showing a direction in which a toner is fed by an upstream side seal and a downstream side seal. Since the development cartridge 28 is of a left-right symmetrical structure, FIG. 3 and FIG. 4 show only the left aide thereof with the right side thereof omitted. In addition, FIG. 3 and FIG. 4 show a state where the developing roller 31 and the supply roller 33 are removed.

As shown in FIG. 3(*a*), the development cartridge 28 includes a developing unit housing 50 that rotatably supports the developing roller 31, and a side sealing member 60 that is brought into sliding contact with corresponding one of end parts of the developing roller 31, in addition to the developing roller 31, etc. described above.

The developing unit housing 50 includes a bearing portion 51 that rotatably supports the developing roller 31, a supply port 52 for supplying toner from the internal toner accommodating chamber 34 to the developing roller 31, and an attaching face 53, the side view of which is arc-shaped. The attaching face 53 is disposed adjacent to each of left and right sides of the supply port 52 (the attaching face 53 disposed adjacent to the left side of the supply port 52 is only shown in FIG. 3(*a*)). The supply port 52 is in the form of a rectangular long hole elongating in the axial direction of the developing roller 31, and the layer thickness regulating blade 32 is fixed to the housing 50 at the upper part of the supply port 52.

The layer thickness regulating blade 32 includes a metal plate 32A, the upper end part of which is fixed to the developing unit housing 50, and a rubber pressing member 32B, as an example of a pressing portion, fixed to the lower edge (distal end) of the metal plate 32A. The metal plate 32A has such a length as to protrude outside the left and right edges of the supply port 52 in the right-left direction, and the metal plate 32A is fixed at the upper side corner parts of left and right end parts thereof to the developing unit housing 50 with screws S. The pressing member 32B has such a length that the pressing member protrudes outside the left and right edges of the supply port 52 in the right-left direction but the left and right edges of the pressing member 32B are positioned inside the left and right edges of the metal plate 32A in the right-left direction (see FIG. 4). The pressing member 32B is brought into sliding contact with the outer circumferential surface of the developing roller 31, while receiving a basing force from the metal plate 32A.

The side sealing member 60 is disposed between corresponding one of the end parts of the developing roller 31 and corresponding one of the attaching faces 53 of the developing unit housing 50 adjacent to the left and right sides of the supply port 52 in the developing unit housing 50. The side sealing member 60 includes an upstream side seal 61 and a downstream side seal 62.

As shown in FIG. 3(*b*), the upstream side seal 61 includes an elastic base 61A and a surface member 61B provided to a surface of the base 61A facing the developing roller 31. The base 61A is formed of an elastic member made, for example, from a urethane sponge, and is adhered directly to the attaching face 53 of the developing unit housing 50 by a double-side adhesive tape T.

As shown in FIG. 3(*c*), the surface member 61B is constructed such that plural capillary members (fibrous members) C are implanted on a base sheet BS, and the surface member 61B thus constructed is adhered to the base 61A by a double-side adhesive tape T. In detail, the surface member 61B is constructed such that capillary bundles CB, each having plural capillary members C bundled together, are arrayed at an interval, and that each capillary bundle CB is tilted in an oblique direction so that a portion of the capillary bundle CB is closer to the supply port 52 as the portion of the capillary bundle CB is closer to the downstream side in the rotational direction of the developing roller 31 (in the direction indicated by an arrow in FIGS. 3(*a*) and 3(*c*))). In more detail, plural rows are arranged at an interval each row having plural capillary bundles CB arranged at an interval in the above-mention oblique. This arrangement can form first guide paths G1 on the surface member 61B between the capillary bundles GB to feed toner in the above-mentioned oblique direction. As shown in FIG. 4, the upstream side seal 61 thus constructed has a width larger in the right-left direction than a width of the downstream side seal 62 to extend toward the supply port 52 beyond the downstream side seal 62.

The surface member 61B can be formed in the following manner: The capillary bundles CB are implanted on a sheet member, the capillary bundles CB on the sheet member are kept tilted in a given direction for a time period so that the capillary bundles CB have a tilting tendency, and thereafter the sheet member with the capillary bundles CB is longitudinally and laterally cut to obtain plural base sheets BS. This method is advantageous in comparison with a method of cutting a sheet member into plural base sheets BS in advance of giving a tilting tendency to capillary bundles CB because tips of capillary members do not protrude from the base sheet BS according to this method. The tips of capillary members protruding from the base sheet toward the supply port may adversely scrap off toner from the developing roller 31, and therefore the surface member 61B constructed according to this method can contributes to maintaining image quality. That is, toner carried on an image-forming range of the developing roller 31 can be prevented from being scrapped off by capillary members.

In FIG. 3(*c*), FIG. 3(*d*) and FIG. 4, the length of implanted capillary members C and the spacing between the capillary bundles CB are shown enlarged for convenience of explanation. Therefore, for example, the length of capillary members C may be made shorter than the length found from these figures, and the capillary bundles may be disposed at a higher density on the entire surface of the base sheet BS than the density found from these figures.

The downstream side seal 62 is disposed at the downstream side, in the rotational direction, of the developing roller 31 relative to the upstream side seal 61. As shown in FIG. 3(*b*), the downstream side seal 62 includes an elastic base 62A and a surface member 62B attached to a surface of the base 62A facing the developing roller 31. The base 62A is an elastic member made, for example, from urethane rubber, and is adhered to the metal plate 32A of the layer thickness regulating blade 32 by a double-sided adhesive tape T so as to protrude from the metal plate 32A toward the upstream side.

As shown in FIG. 3(*d*), the surface member 62B includes plural capillary bundles CB and a base sheet BS similarly to the surface member 61B of the upstream side 61. The capillary bundles CB on the surface member 62B are tilted in a direction different from the direction in which the capillary bundles CB on the surface member 61B of the upstream side seal 61 are tilted. That is, the surface member 62B is constructed such that plural rows are arranged at an interval in the axial direction of the developing roller 31, each row having plural capillary bundles CB arranged at an interval in the rotational direction of the developing roller 31, and that the capillary bundles CB are tilted toward the downstream side to extend in the rotational direction of the developing roller 31. Consequently, the second guide paths G2, along which toner can be fed toward the downstream side in the rotational direction, are formed on the surface member 62B between the capillary bundles CB.

The surface member 62B has a length longer in the rotational direction than a length of the base 62A so that the surface member 62B extends toward the upstream side in the rotational direction beyond the base 62A as shown in FIG. 3(*b*). The extension portion of the surface member 62B, which protrudes from the base 62A toward the upstream side in the rotational direction, is disposed between the base 61A of the upstream side seal 61 and the surface member 61B thereof. Accordingly, the surface member 61B of the upstream side seal 61 overlaps the surface member 62B of the downstream side seal 62.

As shown in FIG. 4, the downstream side seal 62 (the base 62A and the surface member 62B) thus constructed is disposed on the layer thickness regulating blade 32 so as to be closely contacted with corresponding one of left and right end edges BE of the pressing member 32B of the layer thickness regulating blade 32 (in FIG. 4, the downstream side seal 62 closely contacted with the left end edge BE of the pressing member 32B is shown). As shown in FIG. 3(*b*), another seal member SM other than the side sealing member 60 is disposed between the layer thickness regulating blade 32 (metal plate 32A) and the attaching face 53 of the developing unit housing 50.

The side sealing member 60 constructed as described above is attached to the layer thickness regulating blade 82 (metal plate 32A) to hang from the film thickness regulating blade 32 (metal plate 32A) prior to attachment of the layer thickness regulating blade 32 to the developing unit housing 50. The layer thickness regulating blade 32 having the side sealing member 60 is fixed to the developing unit housing 50 by screws S, and the base 61A of the upstream side seal 61 is adhered to the attaching face 53 of the developing unit housing 50. By this simple way, the layer thickness regulating blade 32 and the side sealing member 60 can be attached to the developing unit housing 50.

As shown in FIG. 3(*a*), a recessed developer receiver 70 that is open only upward is formed at the upstream side of the upstream side seal 61. In detail, the developer receiver 70 is formed by a bottom wall part 71 (a part of the attaching face 53) of the housing 50, an inner wall part (right wall part in FIG. 3(*a*)) 72 of the housing 50, an outer wall part (left wall part in FIG. 3(*b*)) 73 of the housing 50, a back side (upstream side) end face 74 of the upstream side seal 61 and a flexible sheet member 75 attached to back side end parts of the bottom wall part 71, the inner wall part 72 and the outer wall part 73.

Next, a description is given of operation of the side sealing member 60.

When toner enters the upstream side seal 61 during rotation of the developing roller 31, toner on the upstream side seal 61 is pushed by the rotating developing roller 31 so that the toner is moved along the first guide paths G1 between the obliquely tilted capillary bundles CB (or along spaces between the capillary members C of the capillary bundles CB) as shown in FIG. 4. Accordingly, the toner is moved toward the supply port 52 and returned to the supply port 52.

When toner enters the downstream side seal 62, toner on the downstream side seal 62 is pushed by the rotating developing roller 31 so that the toner is moved toward the downstream side along the second guide paths G2 between the capillary bundles CB tilted toward the downstream side in the rotational direction (or spaces between capillary members C of the capillary bundles CB). Accordingly, the toner is carried by the developing roller 31 during the movement of the toner on the downstream side seal 62 toward the downstream side in the rotational direction, and therefore the toner is conveyed by the developing roller 31 to be returned to the upstream side seal 61. The toner returned to the upstream side seal 61 is obliquely moved on the upstream side seal 61 to be returned to the supply port 52 as described above.

Accordingly, the following effects can be obtained.

Even when toner enters the upstream side seal 61 and the downstream aide seal 62, the upstream side seal 61 can feed the toner obliquely to return the toner to the supply port 52. Accordingly, it is possible to prevent toner from leaking.

Since the upstream side seal 61 and the downstream side seal 62 are arranged so that the surface member 61B of the upstream side seal 61 is disposed on and overlapped with the surface member 62B of the downstream side seal 62, it is possible to prevent the downstream side seal 62 from being turned over by rotation of the developing roller 31.

Since the downstream side seal 62 is closely contacted with the end edge BE of the pressing member 32B of the layer thickness regulating blade 32, toner can be prevented from leaking therebetween.

Since the upstream side seal 61 extends toward the supply port 52 beyond the downstream side seal 62, it is possible to prevent toner from flowing from the supply port 52 to a boundary between the end edge BE of the pressing member 32B and the downstream side seal 62 by the extended portion of the upstream side seal 61 beyond the downstream side seal 62.

Since the recessed developer receiver 70 is formed at the upstream side of the upstream side seal 61, the developer receiver 70 can receive toner even in a case where toner conveyed from the downstream side seal 62 by the developing roller 31 is scraped and dropped by the edge of the upstream side seal 61. Therefore, it is possible to prevent toner from leaking from the development cartridge 28.

Since the comparatively wide guide paths G1 and G2 can be formed between the capillary bundles CB tilted in respective predetermined directions, toner can be smoothly sent in those predetermined directions. In addition, the capillary bundles CB preferably have such a length that a tip of a capillary bundle CB can contact a root portion of an adjacent capillary bundle CB. This is because toner can be prevented from flowing out from one guide path G1, G2 to an adjacent guide path G1, G2, and thus the flow of toner can be smoothened.

Since the base 62A of the downstream side seal 62 is adhered to protrude from the metal plate 32A of the layer thickness regulating blade 32 toward the upstream side, toner can be prevented from leaking between the base 61A of the upstream side seal 61 and the surface member 62B of the downstream side seal 62.

The present invention is not limited to the above-described exemplary embodiment, and can be embodied in various ways including, for example, the following modifications.

In the embodiment, the capillary bundles CB are tilted in a given direction to feed toner in the given direction. However, the present invention is not limited thereto. For example, plural rows, each having capillary bundles standing upright from the base sheet and being arranged closely to one another in the given direction (the oblique direction or the rotational direction as described above), may be provided to feed toner in the given direction. Alternatively, such a woven fabric that yarns exposed therefrom to the developing roller 31 are oriented in the given direction (the oblique direction or the rotational direction as described above) may be used to feed toner in the given direction. Alternatively, in place of capillary bundles CB, plural capillary members may be densely arranged on the entire surface of the base sheet to tilt toward the downstream side, to thereby feed toner along the capillary members. In addition, the downstream side seal is not necessarily configured to convey toner toward the downstream side, and for example, a felt member having fibers that are not unidirectional may be adopted as the downstream side seal.

In the embodiment, the surface member 62B of the downstream side seal 62 protrudes from the base 62A toward the upstream side. However, the present invention is not limited thereto. The surface member 61B of the upstream side seal 61 may protrude from the base 61A toward the downstream side. In this case, since the surface member 61B of the upstream side seal 61 can be disposed on and overlapped with the surface member 62B of the downstream side seal 62, it is also possible to prevent the downstream side seal 62 from being turned over by rotation of the developing roller 31.

In the embodiment, the downstream side seal 62 is adhered to the metal plate 32A of the layer thickness regulating blade 32. However, the present invention is not limited thereto. For example, in a case where the metal plate 32A of the layer thickness regulating blade 32 has the same dimension as the pressing member 32B in the right-left direction, the downstream side seal 62 may be adhered directly to the developing unit housing 50.

In the embodiment, the development cartridge 28 integrally provided with the toner accommodating chamber 34 is adopted as an example of the developing unit. However, the present invention is not limited thereto. A cartridge to which a separate toner cartridge having a toner accommodating chamber is removably mountable may be adopted as the developing unit.

In the embodiment, toner is conveyed using the guide path G1, G2 between the capillary bundles CB tilted in a given direction. However, the present invention is not limited thereto. Capillary members densely provided on the entire surface of the base sheet and tilted in the given direction may be used to convey toner along the capillary members.

As discussed above, the present invention can provide at least the following illustrative, non-limiting embodiment:

(1) A developing unit including: a developer carrier for carrying a developer; a developing unit housing that rotatably supports the developer carrier and that has a supply port for supplying the developer to the developer carrier; a side sealing member that is disposed between one of end parts of the developer carrier and a portion of the developing unit housing adjacent to the supply port and that is slidingly contactable with the developer carrier; wherein the side sealing member includes an upstream side seal and a downstream side seal that is disposed in a downstream side in a rotational direction relative to the upstream side seal; the upstream side seal is configured to convey the developer in an oblique direction toward the supply port and the downstream side, and the downstream side seal is configured to convey the developer toward the downstream side.

Here, the "rotational direction" means a direction in which the developer carrier slidingly contacts with the side sealing member.

According to the developing unit of (1), assuming that a developer enters the upstream side seal, the developer on the upstream side seal is moved in the oblique direction toward the supply port and the downstream side when the developer carrier is rotated in the rotational direction, to be returned to the supply port. Assuming that a developer enters the downstream side seal, the developer on the downstream side seal is moved to the downstream side when the developer carrier is rotated in the rotational direction. During the movement of the developer on the downstream side seal, the developer carrier carries and conveys the developer to return the developer to the upstream side seal. The developer returned to the upstream side seal is moved in the oblique direction to be returned to the supply port. Accordingly, it is possible to prevent the developer from leaking.

What is claimed is:

1. A developing unit comprising:

a developer carrier configured to carry a developer, the developer carrier having axial end parts;

a housing that rotatably supports the developer carrier and that has a supply port, through which the developer is configured to be supplied to the developer carrier; and a side sealing member that is disposed between one of the axial end parts of the developer carrier and a portion of the housing adjacent to the supply port and that is slidingly contactable with the developer carrier; wherein the side sealing member includes an upstream side seal and a downstream side seal that is disposed on a downstream side in a rotational direction of the developer carrier relative to the upstream side seal;

the upstream side seal is configured to convey the developer on the upstream side seal in an oblique first direction toward the supply port and the downstream side when the developer carrier is rotated in the rotational direction, the upstream side seal has implanted capillary members slidingly contactable with the developer carrier, the capillary members being tilted in the first direction, and the downstream side seal is configured to convey the developer on the downstream side seal in a second direction toward the downstream side when the developer carrier is rotated in the rotational direction.

2. The developing unit according to claim 1, wherein each of the upstream and downstream side seal includes an elastic base and a surface member on a surface of the base facing the developer carrier; and the surface member of the upstream side seal is disposed on and overlapped with the surface member of the downstream side seal.

3. The developing unit according to claim 1, further comprising:

a layer thickness regulating member that is disposed on the housing, and that is configured to regulate a thickness of the developer carried on the developer carrier, wherein the regulating member includes a pressing portion slidingly contactable with the developer carrier, and the downstream side seal is closely contacted with a side edge of the pressing portion in an axial direction of the developer carrier.

4. The developing unit according to claim 3, wherein the upstream side seal extends toward the supply port beyond the downstream side seal.

5. The developing unit according to claim 1, further comprising:

a recessed developer receiver, wherein the upstream side seal is disposed adjacent to the recessed developer receiver and between the recessed developer receiver and the downstream side seal.

6. The developing unit according to claim 1, wherein the first direction intersects the rotational direction, and the second direction is substantially parallel to the rotational direction.

* * * * *